US007424233B2

(12) United States Patent
Saeki

(10) Patent No.: US 7,424,233 B2
(45) Date of Patent: Sep. 9, 2008

(54) IMAGE FORMING APPARATUS FOR FORMING IMAGES WITH AT LEAST TWO PROCESS SPEEDS

(75) Inventor: Kazuchika Saeki, Saitama (JP)

(73) Assignee: Ricoh Company Limited, Tokyo (JP)

( * ) Notice: Subject to any disclaimer, the term of this patent is extended or adjusted under 35 U.S.C. 154(b) by 328 days.

(21) Appl. No.: 11/203,229

(22) Filed: Aug. 15, 2005

(65) Prior Publication Data

US 2006/0045554 A1 Mar. 2, 2006

(30) Foreign Application Priority Data

Sep. 2, 2004 (JP) ..... 2004-255025

(51) Int. Cl.
*G03G 15/16* (2006.01)

(52) U.S. Cl. ..... 399/66; 399/302; 399/308

(58) Field of Classification Search ..... 399/66, 399/302, 308

See application file for complete search history.

(56) References Cited

U.S. PATENT DOCUMENTS 6,336,025 B1 1/2002 Saeki

FOREIGN PATENT DOCUMENTS

| | | |
|---|---|---|
| JP | 5-11562 | 1/1993 |
| JP | 8-292655 | 11/1996 |
| JP | 2579137 | 11/1996 |
| JP | 08286528 A * | 11/1996 |
| JP | 2002-116643 | 4/2002 |
| JP | 2002-229344 | 8/2002 |

OTHER PUBLICATIONS

English Translation of JP 08-286528.*

* cited by examiner

*Primary Examiner*—David M. Gray
*Assistant Examiner*—Ryan D Walsh
(74) *Attorney, Agent, or Firm*—Oblon, Spivak, McClelland, Maier & Neustadt, P.C.

(57) ABSTRACT

An image forming apparatus forms a multiple-color image with at least two process speeds. A secondary-transfer-bias applying unit applies a bias to a secondary transfer unit at a non-image-formation time. A secondary-transfer-output detecting unit detects an output value with respect to each of the at least two process speeds. A secondary-transfer-bias control unit determines a secondary transfer bias to be applied to the secondary transfer unit based on the output value detected.

12 Claims, 4 Drawing Sheets

IMAGE FORMING APPARATUS FOR FORMING IMAGES WITH AT LEAST TWO PROCESS SPEEDS

CROSS-REFERENCE TO RELATED APPLICATIONS

The present document incorporates by reference the entire contents of Japanese priority document, 2004-255025 filed in Japan on Sep. 2, 2004.

BACKGROUND OF THE INVENTION

1. Field of the Invention

The present invention relates to image forming apparatuses, such as copying machines, facsimile machines, printers, employing a digital copying method, and more particularly, to a full-color image forming apparatus including an intermediate transfer member.

2. Description of the Related Art

In a conventional image forming apparatus, a toner image formed on an image carrier (hereinafter, "photosensitive member") is transferred to a transfer medium to form a toner image. A fixing device fixes the toner image on the transfer medium by subjecting it to pressure and heat. In a full color image forming apparatus such as the ones disclosed in Japanese Patent No. 2579137 and Japanese Patent Application Laid-Open Publication No. H08-292655, the transfer medium is borne by a transfer drum serving as a transfer member. Each of the toner images, namely, yellow, magnet, cyan, and black, is transferred sequentially to the transfer medium while being borne by the transfer member. The transfer medium is then lifted off the transfer member and conveyed to the fixing device for fixing.

Alternatively, instead of transferring the toner images to the transfer medium borne by the transfer member, in the full color image forming apparatus disclosed in Japanese Patent Application Laid-Open Publication No. H5-11562, the four toner images may be superposed on an intermediate transfer member, transferred to the transfer medium all at once, and fixed by the fixing device. In the full color image forming apparatus provided with the intermediate transfer member disclosed in Japanese Patent Application Laid-Open Publication No. 2002-229344, as many photosensitive members are arranged in a series as there are toner colors, thereby enabling transfer of all the toner images within the time the intermediate transfer member completes one turn and realizing increased printing speed.

The image forming apparatus provided with the intermediate transfer member obviates the need for the transfer member for bearing the transfer medium. Consequently, a variety of transfer mediums ranging from thin paper sheets (40 $g/m^2$) to thick paper sheets (200 $g/m_2$), to postcards and envelopes can be used. An intermediate transfer drum or an intermediate transfer belt is used as the intermediate transfer member.

Incidentally, even though the full color image forming apparatus provided with the intermediate transfer member allows usage of a wide variety of transfer mediums, the difference in the thickness of the transfer medium leads to a difference in the fixing capacity due to a difference in the amount of heat. This is particularly pronounced in the full color image forming apparatus, which produces full color images by superposing a plurality of toner images. Specifically, if a thin paper sheet is conveyed to the fixing device under a normal process speed, the toner fixing is carried out normally. However, if a thick paper sheet is conveyed to the fixing device under the same conditions, inadequate cohesion of toner results, resulting in the adhesion of the toner to the fixing roller. The toner from the fixing roller is transferred back to transfer medium, resulting in a so-called fixing offset. The lack of close adhesion of the toner to the transfer medium leads to toner peeling. Thus, when two or more toner images are superposed, the desired color is not obtained due to inadequate toner cohesion.

To remedy the problem, an image forming apparatus such as the one disclosed in Japanese Patent Application Laid-Open Publication No. 2002-116643 is proposed in which fixing is carried out at half the normal process speed (hereinafter, "half-speed") for the transfer medium with a high amount of heat such as, thick paper sheets, OHP sheets, etc. However, the following problems are encountered in the full color image forming apparatus provided with the intermediate transfer member and a mechanism for adjusting the process speed according to the type of transfer medium.

In the image forming apparatus in which a secondary transfer bias value is determined by finding a resistance of a secondary transfer means in a non-image portion, the secondary transfer bias value to be applied at half-speed is estimated based on the resistance determined at normal speed. Consequently, the transferability is adversely affected if the estimated value is off the actual optimum value.

Specifically, even if the resistances were the same at normal speed, at half-speed the resistance values differed.

Upon investigation, the reasons for this difference were found to be as follows:

(1) the resistance of the secondary transfer section is the combined resistances of the intermediate transfer member and the intermediate transfer means, etc. which form the secondary transfer section; and (2) the ease with which the electric current flows under different processing conditions differs according to the members through which it flows.

SUMMARY OF THE INVENTION

It is an object of the present invention to at least solve the problems in the conventional technology.

An image forming apparatus according to one aspect of the present invention, which forms a multiple-color image with at least two process speeds, includes an image carrier on which a latent image is formed; a latent-image forming unit that forms the latent image on the image carrier; a color developing unit of a plurality of colors that forms a toner image on the latent image; a primary transfer unit that sequentially transfers the toner image formed on the image carrier to an intermediate transfer member in a superposing manner; a secondary transfer unit that transfers the toner image from the intermediate transfer member to a transfer medium; a secondary-transfer-bias applying unit that applies a bias to the secondary transfer unit; a secondary-transfer-bias control unit that controls the bias applied to the secondary transfer unit to a predetermined value; and a secondary-transfer-output detecting unit that detects an output value of the secondary transfer unit from the bias applied to the secondary transfer unit. The secondary-transfer-bias applying unit applies the bias to the secondary transfer unit at a non-image-formation time. The secondary-transfer-output detecting unit detects the output value with respect to each of the at least two process speeds. The secondary-transfer-bias control unit determines the predetermined value based on the output value detected.

A method according to another aspect of the present invention, which is for determining a secondary transfer bias value for an image forming apparatus that forms a multiple-color image with at least two process speeds, includes applying a bias to a secondary transfer unit of the image forming apparatus during a non-image-formation time; detecting an output value of the secondary transfer unit with respect to each of the at least two process speeds; and determining a secondary transfer bias to be applied to the secondary transfer unit based on the output value detected.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
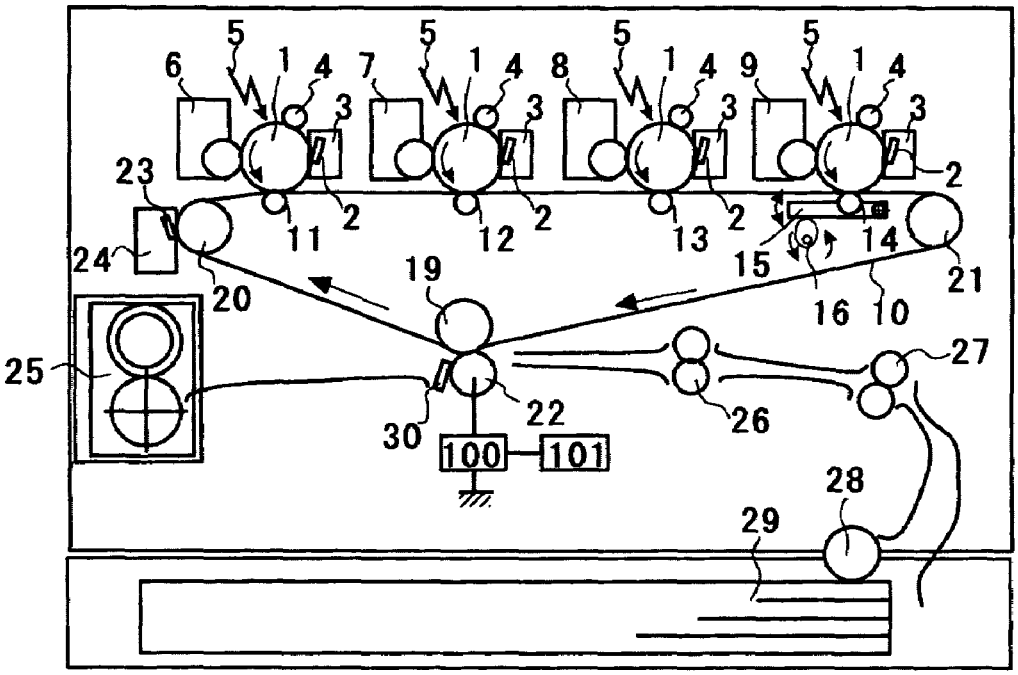
FIG. 1 is a schematic of a tandem-type full-color image forming apparatus according to the present invention.

Exemplary embodiments of the present invention are explained in detail with reference to the accompanying drawings. FIG. 1 is a schematic of a color image forming apparatus according to the present invention, which includes an intermediate transfer belt that serves as an intermediate transfer member. The reference numeral 1 is a photosensitive drum, which is cylindrical and turns at a rate of 150 mm/sec in the direction of the arrow shown in FIG. 1. A charging device 4, which is a charging means in the form of a roller, is disposed pressing against the photosensitive drum 1 and turns, driven by the photosensitive drum 1. The photosensitive drum is uniformly charged to a surface potential of −500 V by application of an AC and DC bias by a not shown high-voltage power source. A latent image is formed on the photosensitive drum 1 when an image data is exposed by a exposing unit 5 that functions as a latent-image forming unit.

The exposure is carried out by a laser beam scanner or a light emitting device (LED) using a laser diode.

A photosensitive drum cleaning unit 3 cleans the residual toner on the surface of the photosensitive drum 1. The reference numeral 2 in FIG. 1 represents a blade of the cleaning unit 3. A developing unit in the present embodiment is a two-component type non-magnetic contact developer and consists of four developers, namely, a yellow developer 6, a cyan developer 7, a magenta developer 8, and a black developer 9. Each of the developers receives a predetermined developing bias from a not shown high-voltage power source and converts the latent image on the photosensitive drum 1 to a visible toner image. Toners used in the first embodiment are polymer toners obtained by polymerization. The shape of the toner particle will be described later.

Four photosensitive drums 1 are lined up. Visible yellow, cyan, magenta, and black toner images are formed, and the images of each of the colors are sequentially transferred to an intermediate transfer belt 10, forming a full color image.

The intermediate transfer belt 10 is tautly stretched over and supported by a drive roller 21, primary transfer bias rollers 11 through 14, a secondary transfer facing roller 19, and a belt cleaning facing roller 20. The intermediate transfer belt 10 is driven to rotate in the direction of the arrow shown in FIG. 1 by a not shown driving motor. The primary transfer bias roller 14 is borne by a primary transfer bias roller bearing member 15. A linking/separating cam 16 presses the primary transfer bias roller 14 towards the photosensitive drum 1. Under normal conditions, the linking/separating cam 16 presses the primary transfer bias roller 14 towards the photosensitive drum 1. When inserting or detaching either the photosensitive drum 1 or the intermediate transfer belt 10, the linking/separating cam turns, releasing the primary transfer bias roller 14.

The primary transfer bias roller is explained later. The reference numeral 24 represents a belt cleaning unit. A blade 23 cleans the intermediate transfer belt 10 by scraping the toner left behind on the intermediate transfer belt 10 after transfer.

Each of the rollers tautly stretching and supporting the intermediate transfer belt 10 is supported on either side of the intermediate transfer belt 10 by a not shown intermediate transfer belt unit side board.

The intermediate transfer belt 10 is an endless resin film belt composed of Polyvinylidene Flouride (PVDF), Ethylene Tetraflouro Ethylene copolymer (ETFE), Polyimide (PI), Polycarbonate (PC), etc. in which electric conductant material such as carbon black is dispersed.

Apart from the resin film belt, other intermediate transfer members having an elastic layer may also be used.

The following materials may be used for making the intermediate transfer member having an elastic layer. For example, one or several of the following materials may be used as rubber and elastomer, namely, natural rubber, epichdrohydrin rubber, acrylic rubber, silicon rubber, flourorubber, polysulfide rubber, polynorbornene rubber, isoprene rubber, styrene-butadiene rubber, butadiene rubber, butyl rubber, ethylene-propylene rubber, ethylene-propylene copolymer, chroloprene ribber, chlorosulfonated polyethylene, chlorinated polyethylene, acryl nitryl butadiene rubber, urethane rubber, syndiotactic 1,2-polybutadiene, hydrogenated nitryl rubber, and thermoplastic elastomer (such as, polystyrene, polyolefin, poly vinyl chloride, polyurethane, polyamide, polyester, and flouro resin)

One or several of the following resin types may be used, namely, styrene resin (single polymer or copolymer including styrene or styrene substitute) such as phenol resin, epoxy resin, polyester resin, polyester polyurethane resin, polyethylene, polypropylene, polybutadiene, polyvinylidene chloride, ionomer resin, polyurethane resin, silicon resin, flouro resin, ketone resin, polystyrene, choloropolystyrene, poly-α-methyl styrene, styrene-butadiene copolymer, styrene-vinyl chloride copolymer, styrene-vinyl acetate copolymer, styrene-maleic acid copolymer, styrene-acrylic ester copolymer (styrene-methyl acrylate coplymer, styrene-ethyl acrylate copolymer, styrene-butyl acrylate copolymer, styrene-methacrylic acid ester copolymer, styrene-phenyl methacrylate copolymer, etc.), styrene-α-methyl chloracrylate copolymer, styrene acryl nitryl-acrylic ester copolymer or methyl methacrylate resin, butyl methacrylate resin, acrylic ester resin, butyle acrylate resin, denatured acrylic resin (silicon denatured acrylic resin, vinyl chloride resin denatured acrylic resin, acryl urathane, etc.), vinyl chloride resin, styrene-vinyl acetate copolymer, vinyl chloride-vinyl acetate copolymer, rosin denatured maleic acid resin, polyamide resin, denatured polyphenylene oxide resin, etc.

To adjust the resistance of the intermediate transfer member, various conductant agents may be added to the rubber, elastomer, and resin. One or several of the following conductant agents may be used, namely, metal powder such as carbon, aluminium, nickel, etc., metallic oxide such as titanium oxide, boron-containing high molecular compound such as methyl polymethacrylate containing tertiary ammonium salt, poly vinyl aniline, polyvinyl pyrrole, polydiacetylene, polyethyleneimine, and polypyrrole, etc.

It is preferable cover the elastic layer with a surface cover made of resin to protect it from staining (bleeding) from the photosensitive drum, toner adherence (filming), as well as with the objective of controlling toner charge, adjusting the surface resistance, controlling the coefficient of friction.

One or several of the following resin types may be used for forming the surface cover of the elastic layer, namely, flouro resin, urethane resin, polycarbonate resin, polyvinyl acetal resin, acrylic resin, silicon resin, polyester resin, amino resin, epoxy resin, polyamide resin, phenol resin, alkyd resin, melamine resin, ketone resin, ionomer resin, polybutadiene resin, chlorinated polyethylene, vinylidene chloride resin, acrylic urethane resin, acrylic silicon resin, ethylene vinyl acetate resin, vinyl chloride vinyl acetate resin, styrene acrylic resin, styrene butadiene resin, styrene maleic acid resin, ethylene acrylic resin, etc.

The intermediate transfer belt 10 according to the present embodiment is composed of a single layer of polyimide (PI) to which carbon black is added. The thickness of the layer is 100 μm.

Incidentally, the resistance of the intermediate transfer belt 10 was measured by connecting a probe (having an inner electrode diameter of 50 mm and a ring electrode inner diameter of 60 mm, according to JIS-K6911 standards) to a digital ultra-high resistance/micro current meter (Product No. R8340, manufactured by Advantest), and a voltage of 100 V (surface resistivity 500 V) was applied to both the surfaces of the intermediate transfer belt 10. The surface resistance during discharge was measured at 5 seconds and during charging was measured at 10 seconds. The temperature was kept constant at 22° C. and the relative humidity at 55% during the measurement of the surface resistance The volume resistivity of the intermediate transfer belt 10 is in the range of $10^7$-$10^{12}$ ohms-cm, and the surface resistivity is in the range of $10^9$-$10^{15}$ ohms-per-square. If the volume resistivity and the surface resistivity of the intermediate transfer belt 10 exceed the specified range, the bias required for transfer increases, increasing power consumption and hence the cost involved. Further, the charge potential of the surface of the intermediate belt 10 increases due to the discharge occurring in the transfer step and the transfer medium separation step, necessitating provision of a discharge unit in the intermediate transfer belt 10 as self-discharge does not occur easily. On the other hand, if the volume resistivity and the surface resistivity of the intermediate transfer belt 10 fall below the specified range, the charge potential drops quickly with a self-discharge. However, toner scattering results due to the current flowing in the direction of the surface during transfer. Thus, the volume resistivity and the surface resistivity of the intermediate transfer belt according to the present invention should be in the range specified earlier.

The reference numeral 22 represents a secondary transfer bias roller. The secondary transfer bias roller is composed of a core grid of SUS grade stainless steel, and the like, with an elastic cover composed of urethane, and the like, whose resistance is adjusted to $10^6$-$10^{10}$ ohms by a conductant material. If the resistance of the secondary transfer bias roller 22 exceeds the specified range, the current cannot flow easily, necessitating high voltage application to accomplish transfer, thereby increasing the power consumption and the cost involved. Application of high voltage causes discharge to occur at the air spaces before and after a transfer nip, resulting in white space on a colored background. This phenomenon is more prominent under low-temperature low-humidity conditions (for example 10° C. and a relative humidity of 15%). On the other hand, if the resistance of the secondary transfer bias roller 22 falls below the specified range, the transfer of the portion of the image made of a plurality of colors (for example, image with three superposed colors) as well as the portion of the image made of a single color cannot be simultaneously carried out. The relatively low voltage produces enough current for the transfer of a single-color image. However, for the transfer of a plural-color image, a higher potential is required. If a higher potential is applied, the transfer current for the single-color image becomes far too much. Thus, transfer efficiency is compromised.

To measure the resistance of the secondary transfer bias roller 22, the secondary transfer bias roller 22 was set on a conductive metal plate. The core grid was weighted with 4.9 N at each end (a total of 9.8 N). The resistance was calculated from the current that flows when a voltage of 1000 V was applied between the core grid and the metal plate. The temperature was kept constant 22° C. and the relative humidity at 55% during measurement of the resistance. Adjustments were made so that the resistance of the secondary transfer bias roller 22 according to the present embodiment measured by the method described above is 7.8 log ohms.

The primary transfer bias rollers 11-14 are structurally similar to the secondary transfer bias roller 22. This structure of the primary transfer bias roller 11-14, which presses against the photosensitive drum 1 with the intermediate transfer belt 10 sandwiched in between, ensures that the elastic layer primary transfer bias roller 11-14 forms a good primary transfer nip. The resistance range of the primary transfer bias roller 11-14 also must be in the similar range as that of the secondary transfer bias roller 22. Adjustments were made so that the resistance of the primary transfer bias roller 11-14 according to the present embodiment measured by the method described above is 7.0 log ohms.

Exactly when the edge of the toner image on the surface of the intermediate transfer belt 10 reaches a secondary transfer position, a transfer medium picked up by a pickup roller 28 and passed to a paper feeding roller 27 and a resist roller 26, is fed to the secondary transfer position. When a high-voltage power supply 100 applies a predetermined transfer bias, the toner image on the intermediate transfer belt 10 is transferred to the transfer medium 29. The transfer medium 29 separates from the intermediate transfer belt 10 due to the curvature of the secondary transfer facing roller 19 and a predetermined separation bias applied by a separating unit 30. The toner image transferred on to the transfer medium 29 is fixed by a fixing unit 25. The transfer medium 29 is then ejected.

The image forming apparatus according to the present invention has four image formation modes, namely, single-color mode, two-color mode, three-color mode, and full color mode, and allows selection of the desired mode by operating an actuator. The single-color mode produces an image of any of the colors yellow, magenta, cyan, and black. Likewise, the two-color mode and three-color mode produce an image of a combination of any two colors or three colors thereof, respectively. The full color mode produces a full color image in which all the four colors are superposed.

In the image forming apparatus according to the present embodiment, the process speed during fixing is adjustable according the type of the transfer medium 29. Specifically, the process speed is made half-speed if a ream weight of the transfer medium is 110 Kg or greater. That is, the transfer medium takes twice as long as the normal time for traversing a fixing nip formed by a pair of fixing rollers, ensuring that the toner image fixed properly.

A ream is a bunch of thousand sheets, all of one specified dimension. Specifically, the weight of a thousand 4/6 sheets is called "ream weight". The unit of ream weight is <Kg>.

The secondary transfer step in which the toner image from the intermediate transfer belt 10 is transferred to the transfer medium 29, also takes place at half-speed. Consequently, a "Thick sheet mode" comes into force when bias is applied to the secondary transfer bias roller 22. In the image forming apparatus according to the present embodiment, the type of the transfer medium can be specified by a not shown actuator. There are three options for transfer medium, namely, "Normal sheet mode" (normal process speed), "Thick sheet mode" (half-speed), "OHP mode" (half speed).

Figure 2:
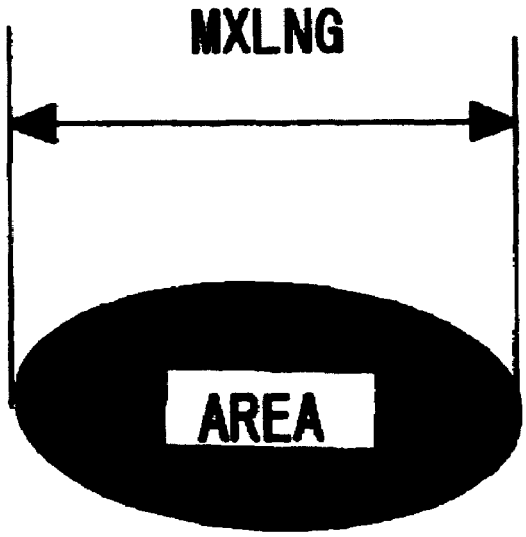
FIG. 2 is a schematic of an example of a shape of toner according to the present invention.
Figure 3:
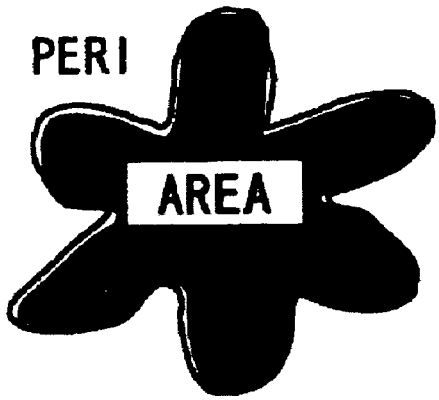
FIG. 3 is a schematic of another example of the shape of toner according to the present invention.

Shape factors SF-1 and SF-2 of the toner used in the image forming apparatus according to the present embodiment should preferably be in the range of 100-180. FIG. 2 and FIG. 3 are schematic diagrams of the shape of the toner illustrating the shape factors SF-1 and SF-2. The shape factor SF-1 indicates a roundness ratio of the shape of toner and is determined by Eq. (1) given below. The shape factor SF-1 is obtained by dividing by a drawing area AREA a maximum length MXLNG of the shape obtained by projecting the toner on a two-dimensional plane, and multiplying the quotient by $100\pi/4$.

$$SF\text{-}1=\{(MXLNG)^2/AREA\}\times(100\pi/4) \quad (1)$$

The toner is perfectly spherical when the value of shape factor SF-1 is 100. As the value gets further from 100, the shape of the toner becomes more indeterminate.

The shape factor SF-2 represents an unevenness ratio of the shape of toner and is determined by Eq. (2) given below. The shape factor SF-2 is obtained by dividing by a drawing area AREA a perimeter PERI of the shape obtained by projecting the toner on a two-dimensional plane, and multiplying the quotient by $100\pi/4$.

$$SF\text{-}2=\{(PERI)^2/AREA\}\times(100\pi/4) \quad (2)$$

The toner surface is devoid of unevenness when the value of shape factor SF-2 is 100. As the value gets further from 100, the unevenness becomes more prominent.

The shape factor was calculated by taking a picture of the toner using a scanning electron microscope (S-800, manufactured by Hitachi), and feeding the picture of the toner into an image analyzer (LUSEX3, manufactured by Nireco).

As the shape of the toner tends towards spherical, the contact surface between two toner particles or between the toner particle and the photosensitive member would tend to be less, weakening the cohesiveness between the toner particles and increasing the mobility of the toner particles. Also, the adhesiveness between the toner particle and the photosensitive member will weaken, increasing the transfer rate. It is preferable that both SF-1 and SF-2 remain under 180, as exceeding 180 would decrease the transfer rate.

Figure 4:
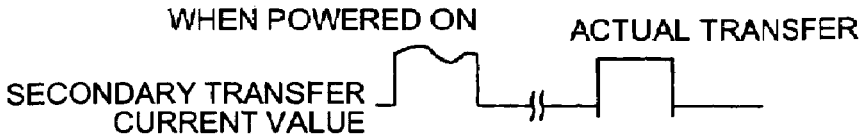
FIG. 4 is a schematic for illustrating a basic sequence of a secondary transfer bias control.

According to a first embodiment of the present invention, a secondary transfer output detection method is applied to a secondary transfer bias control in an image forming apparatus with four photosensitive drums. The basic sequence of the secondary transfer bias control is illustrated in FIG. 4. When the image forming apparatus is powered on, the high-voltage power source 100 applies a voltage to maintain the voltage of the secondary transfer bias roller 22 constant at a predetermined value (1000 V in the present embodiment). A current value at the predetermined voltage is detected by a current detecting unit 101. The detected current value is used for calculating a transfer current value. The calculated transfer current value is kept constant during image formation. It is preferable to detect the secondary transfer output current value under conditions similar to when actual secondary transfer takes place, as it yields a more accurate detection. Therefore, it is preferable that a predetermined primary transfer bias (a constant current of 15 μA in the present embodiment) is applied to the primary transfer bias roller 11 to 14.

Figure 5:
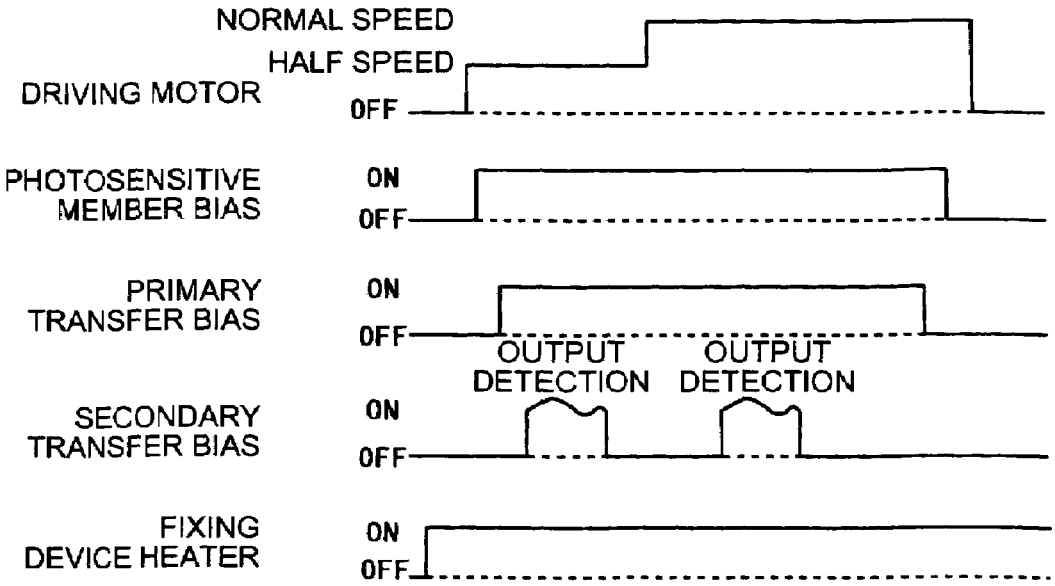
FIG. 5 is a timing chart of a secondary transfer output detection when the image forming apparatus is powered on, according to a first embodiment of the present invention.

FIG. 5 is a timing chart of a secondary transfer output detection when the image forming apparatus is powered on. After the image forming apparatus is powered on and the fixing device attains a predetermined temperature, the photosensitive drum 1 and the intermediate transfer belt 10 rotate, driven by a not shown driving motor. The photosensitive drum 1 and the intermediate transfer belt 10 are driven to rotate at half-speed (75 mm/sec in the present embodiment). The voltage of the secondary transfer bias roller 22, which is already kept pressing against the intermediate transfer belt 10, is controlled at a predetermined value and a current value I1 under this voltage is detected. Next the photosensitive drum 1 and the intermediate transfer belt 10 are driven to rotate at normal speed (150 mm/sec in the present embodiment). Following the same steps as for half-speed, a current value I2 is detected. The current values I1 and I2 are used in Eq. (3) to determine transfer current values I1t and I2t required during image formation and the respective transfer current value is applied during the image formation at the relevant process speed.

$$I1(\text{or } I2)\times F1(\text{or } F2)=I1t(\text{or } I2t) \quad (3)$$

where F1 (or F2) represents correction factor determined in advance from the respective process speed.

Thus, by devising a structure in the manner described earlier, the secondary transfer output voltage value is detected for a plurality of process speeds. Consequently, an optimum secondary transfer current applicable for the relevant process speed can be calculated irrespective of the dependence of the volume resistivity of the intermediate transfer belt 10 and the secondary transfer bias roller 22 on the process speed.

According to a second embodiment of the present invention, the high-voltage power source maintains the current value of the secondary transfer bias roller 22 constant at a predetermined value (10 μA in the present embodiment). A voltage value at the predetermined current value is detected by a voltage detecting unit 101. The detected voltage value is used for calculating a transfer current value. The calculated transfer current value is kept constant during image formation. In the present embodiment too, it is preferable to detect the secondary transfer output current value under conditions similar to when actual secondary transfer takes place, as it yields a more accurate detection. Therefore, it is preferable that a predetermined primary transfer bias is applied to the primary transfer bias roller 11 to 14.

According to the second embodiment, the voltage values at half-speed and normal speed are detected to be V1 and V2, respectively. The voltage values V1 and V2 are used in Eq. (4) to determine transfer current values I1t' and I2t' required during image formation and the respective transfer current value is applied during the image formation at the relevant process speed.

$$V1(\text{or } V2)\times F1'(\text{or } F2')=I1t'(\text{or } I2t') \quad (4)$$

where F1' (or F2') represents correction factor determined in advance from the respective process speed.

Thus, by devising a structure in the manner described earlier, the secondary transfer output voltage value is detected for a plurality of process speeds. Consequently, an optimum secondary transfer current applicable for the relevant process speed can be calculated irrespective of the dependence of the volume resistivity of the intermediate transfer belt 10 and the secondary transfer bias roller 22 on the process speed.

According to a third embodiment of the present invention, the secondary transfer output detection is carried out not when the image forming apparatus is powered on as in the first embodiment and the second embodiment, but during every image formation operation.

Figure 6:
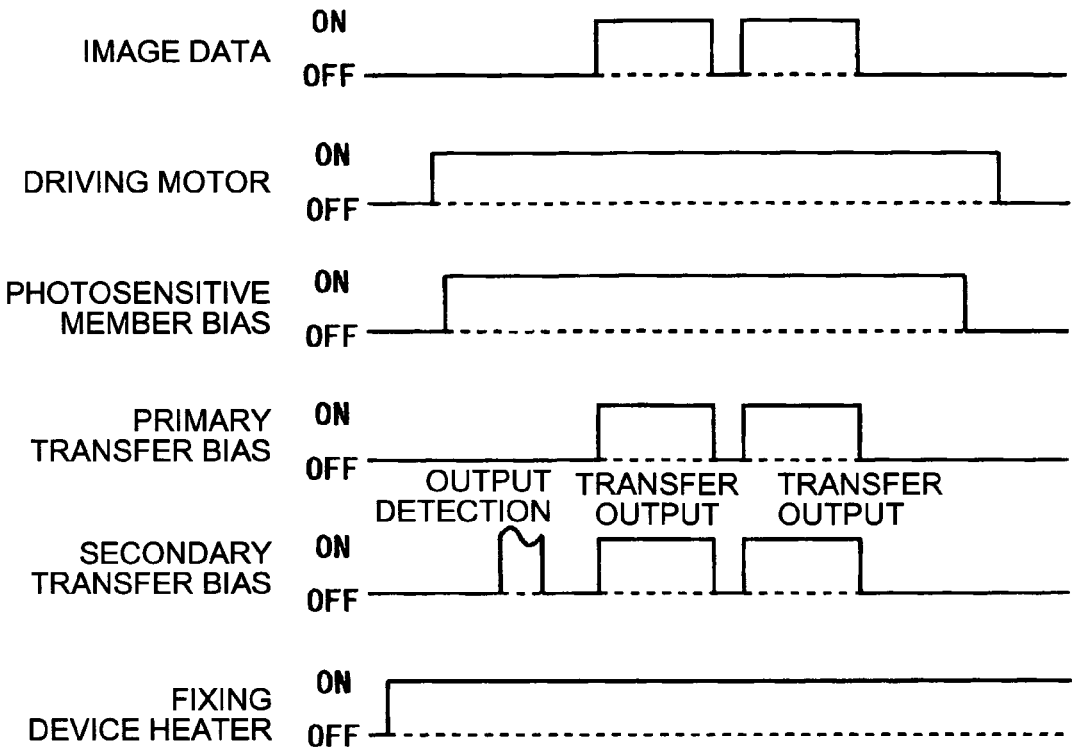
FIG. 6 is a timing chart of the secondary transfer output detection in the tandem-type full-color image forming apparatus during image formation, according to a third embodiment of the present invention.

FIG. 6 is a timing chart of the secondary transfer output detection in the tandem-type full-color image forming apparatus during image formation, according to a third embodiment. Image formation starts when the photosensitive drum 1 and the intermediate transfer belt 10 are rotated, driven by a not shown driving motor. Since process speed is preset according to the transfer medium 29 used, the voltage value of the secondary transfer bias roller 22, which is kept pressing against the intermediate transfer belt 10, is maintained at a predetermined value. The current value I1 (for half-speed) (or I2 for normal process speed) at the predetermined voltage is detected.

The transfer current values I1t and I2t are determined by using the current value I1 and I2 in Eq. (3) given earlier. Application of the transfer current value is identical to that in the first embodiment.

Thus, by devising a structure in the manner described earlier, the secondary transfer output detection is carried out during every image formation operation. Consequently, an optimum secondary transfer current is determined even if the resistance of the secondary transfer portion varies due to environmental factors, such as temperature, humidity, etc.

Figure 7:
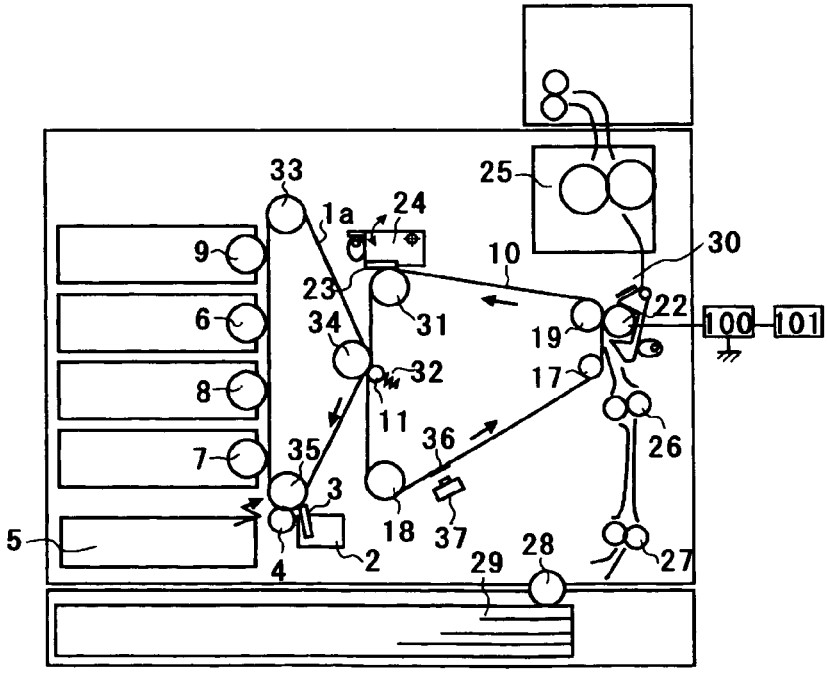
FIG. 7 is a schematic of the full-color image forming apparatus according to a fourth embodiment of the present invention.

According to a fourth embodiment of the present invention, the image forming apparatus has a single photosensitive member. FIG. 7 is a schematic of the image forming apparatus according to the fourth embodiment. In FIG. 7 the photosensitive member is represented by a photosensitive belt 1*a*. The parts in FIG. 7 that are functionally similar to those in FIG. 1 are not described again.

The photosensitive belt 1*a* is tautly stretched over and supported by rollers 33, 34, and 35. A spring 32 presses down the primary transfer bias roller against the photosensitive belt 1*a*. The intermediate transfer belt 10 is stretched and supported by rollers 17, 18, 19, and 31.

The reference numeral 23 represents a position detection mark that detects the position of the intermediate transfer belt 10. The reference numeral 24 represents a position detection sensor 24 that detects the position detection mark 23. A good full color image without color shift can be obtained by an accurate detection of the position detection mark 23.

Figure 8:
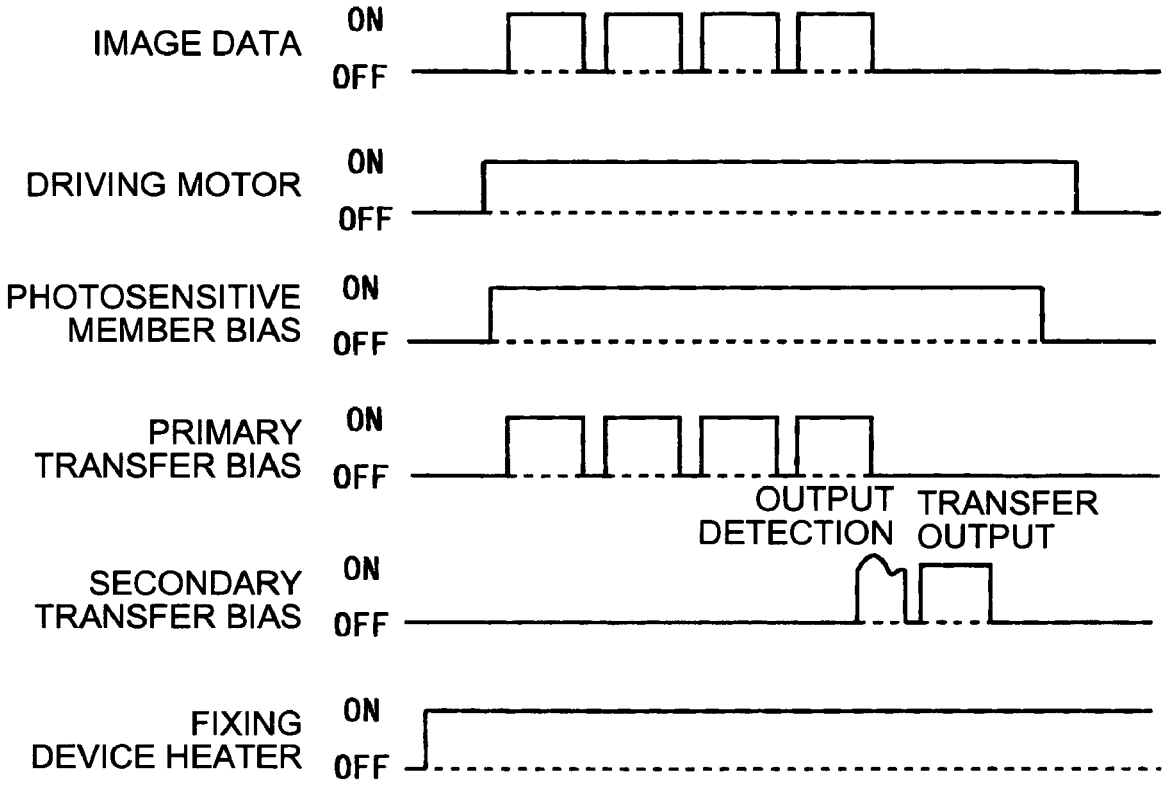
FIG. 8 is a timing chart of the secondary transfer output detection in the full color image forming apparatus according to the fourth embodiment.

Since there is only a single photosensitive belt 1*a* in the present embodiment, when forming a full color image, the toner image of each color is sequentially formed on the photosensitive member, the toner images are one by one transferred to the intermediate transfer belt 10 by the primary transfer bias roller 11, and are all at once transferred to the transfer medium 29 by the secondary transfer bias roller 22. In the present embodiment, the photosensitive belt 1*a* and the intermediate transfer belt 10 are driven to rotate at normal speed right up to the step prior to bulk transfer of the toner images to the transfer medium 29, to increase the production efficiency of image formation, even if thick sheets are used as the transfer medium 29. Once the all toner images are superposed on the intermediate transfer belt 10, the driving motor reduces the rotation speed of the photosensitive belt 1*a* and the intermediate transfer belt 10 to half-speed. The bulk transfer of the toner images is timed to coincide with the timing when the transfer medium 29 reaches the secondary transfer position. FIG. 8 is a timing chart that represents the operation described above.

The secondary transfer output detection method in the present embodiment is similar to that of the first embodiment.

According to the fourth embodiment, the secondary transfer output detection is carried out just before the secondary transfer is carried out. Consequently, an optimum secondary transfer current can be determined without compromising the production efficiency even in full color image forming apparatuses having only one photosensitive member, irrespective of the variation in the secondary transfer portion due to environmental factors such as temperature, humidity, etc.

In the image forming apparatus according to a fifth embodiment of the present invention, conditions such as "Paper width", "Temperature/humidity conditions", "First surface or Second surface", "Number of colors (single color through four colors) are considered when correction is carried out using $$I1(\text{or } I2)\times F1(\text{or } F2)\times W1(\text{or } W2)\times E1(\text{or } E2)\times Dup1(\text{or } Dup2)\times C1(\text{or } C2 \text{ through } C4)=I1t(\text{or } I2t)$$

where F1 (or F2) is the correction factor determined beforehand from the process speed, W1 (or W2) is the correction factor determined beforehand from the paper width, Dup1 (or Dup2) is the correction factor determined beforehand from whether printing is being carried out on the first surface or the second surface, and C1 (or C2 through C4) is the correction factor determined beforehand from the number of colors to be used while printing.

Thus, by devising a structure in the manner described earlier, when detecting the secondary transfer output voltage value, along with the process speeds other conditions are also considered. Consequently, an optimum secondary transfer current can be determined.

The present invention is not limited to the embodiments described so far. A belt form intermediate transfer belt is used in the embodiments of the present invention. However, the intermediate transfer member may be in the form of a drum consisting of a metal roller with a conductant elastic layer provided thereon. In the embodiments of the present invention, the bias is calculated using mathematical equations. However, bias may be determined from a table. In the embodiments of the present invention, the bias during transfer is applied under a constant current. However, the bias during transfer may also be applied under a constant voltage. Only two process speeds are considered in the embodiments of the present invention. However, more than two process speeds may be considered.

As described above, according to the present invention, the secondary transfer bias is controlled to be optimum at all times irrespective of the process speed. Consequently, a high transfer rate is realized and a good full color image can be produced.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms a multiple-color image with at least two process speeds, the image forming apparatus comprising:

an image carrier on which a latent image is formed;

a latent-image forming unit that forms the latent image on the image carrier;

a color developing unit of a plurality of colors that forms a toner image on the latent image;

a primary transfer unit that sequentially transfers the toner image formed on the image carrier to an intermediate transfer member in a superposed manner;

a secondary transfer unit that transfers the toner image from the intermediate transfer member to a transfer medium, the secondary transfer unit including a secondary-transfer-bias applying member configured to be moveable relative to an outer surface of the intermediate transfer member and to apply a secondary bias from a transfer-bias source to the intermediate transfer member;

a secondary-transfer-bias control unit that controls the bias applied to the secondary transfer applying member to a predetermined value; and a secondary-transfer-output detecting unit that detects a first output value of the secondary-transfer-bias applying member with respect to a first one of the at least two processing speeds and a second output value with respect to a second one of the at least two processing speeds, both the first output value and the second output value being further detected at a non-image-formation time and when the secondary-transfer-bias applying member is directly engaged with the intermediate transfer member, wherein the secondary-transfer-bias control unit determines the predetermined value based on the first output value and the second output value detected by the secondary-transfer-output detecting unit.

2. The image forming apparatus according to claim 1, wherein the secondary-transfer-output detecting unit detects the first out put value and the second output value by applying a predetermined constant voltage to the secondary-transfer-bias applying member and detecting a current when the predetermined constant voltage is applied.

3. The image forming apparatus according to claim 1, wherein the secondary-transfer-output detecting unit detects the first output value and the second output value by applying a predetermined constant current to the secondary-transfer-bias applying member and detecting a voltage when the predetermined constant current is applied.

4. The image forming apparatus according to claim 1, wherein, the intermediate transfer member is an intermediate transfer belt supported by a plurality of rollers.

5. The image forming apparatus according to claim 4, wherein the intermediate transfer belt includes a single primary transfer unit.

6. The image forming apparatus according to claim 4, wherein the intermediate transfer belt is a tandem-type intermediate transfer unit having a plurality of primary transfer units.

7. The image forming apparatus according to claim 1, wherein the secondary transfer member is a rotating transfer roller.

8. The image forming apparatus according to claim 1, wherein a toner that is used to form the toner image is a polymer toner manufactured by a polymerization method.

9. The image forming apparatus according to claim 8, wherein a first shape factor and a second shape factor of the toner are in a range between 100 and 180.

10. The image forming apparatus according to claim 1, wherein the secondary-transfer-output detecting unit is configured to begin detecting when the image forming apparatus is powered on.

11. A method of determining a secondary transfer bias value for an image forming apparatus that forms a multiple-color image with at least two process speeds on a medium after the multiple-color image is transferred from a primary image forming unit to an intermediate transfer member, the method comprising:

applying a bias to a secondary transfer member engaged with the intermediate transfer member during a non-image-formation time;

detecting an output value of the secondary transfer member with respect to each of the at least two process speeds while the secondary transfer member is engaged with the intermediate transfer member during a non-image-formation time; and determining a secondary transfer bias to be applied to the secondary transfer member using each output value detected relative to the at least two process speeds.

12. The method of determining a secondary transfer bias value for an image forming apparatus according to claim 11, wherein the detecting step begins when the image forming apparatus is powered on.

* * * * *